US009156292B2

(12) United States Patent
Sakano

(10) Patent No.: US 9,156,292 B2
(45) Date of Patent: Oct. 13, 2015

(54) RECORDING APPARATUS

(71) Applicant: BROTHER KOGYO KABUSHIKI KAISHA, Nagoya-shi, Aichi-ken (JP)

(72) Inventor: Yuji Sakano, Toyota (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/039,870

(22) Filed: Sep. 27, 2013

(65) Prior Publication Data

US 2014/0092190 A1 Apr. 3, 2014

(30) Foreign Application Priority Data

Sep. 28, 2012 (JP) ..... 2012-218363

(51) Int. Cl.

| | |
|---|---|
| ***B41J 13/00*** | (2006.01) |
| ***B41J 11/00*** | (2006.01) |
| ***B41J 3/60*** | (2006.01) |
| ***B41J 13/10*** | (2006.01) |

(52) U.S. Cl.

CPC ..... *B41J 13/0018* (2013.01); *B41J 3/60* (2013.01); *B41J 11/00* (2013.01); *B41J 11/0045* (2013.01); *B41J 13/00* (2013.01); *B41J 13/103* (2013.01)

(58) Field of Classification Search

None

See application file for complete search history.

(56) References Cited

U.S. PATENT DOCUMENTS

| | | | | |
|---|---|---|---|---|
| 5,657,983 | A * | 8/1997 | Fisk | 271/251 |
| 7,192,025 | B1 | 3/2007 | Golicz et al. | |
| 2003/0076399 | A1 | 4/2003 | Matsuo et al. | |
| 2005/0062827 | A1 * | 3/2005 | Otsuka et al. | 347/104 |
| 2008/0024808 | A1 | 1/2008 | Masuda | |
| 2010/0270728 | A1 | 10/2010 | Hoover et al. | |
| 2011/0242188 | A1 | 10/2011 | Sakano | |
| 2014/0092189 | A1 | 4/2014 | Sakano | |
| 2015/0029286 | A1 | 1/2015 | Yagi et al. | |

FOREIGN PATENT DOCUMENTS

| | | | |
|---|---|---|---|
| CN | 1491803 | A | 4/2004 |
| CN | 102218906 | A | 10/2011 |
| JP | H05-131696 | A | 5/1993 |
| JP | H06-161172 | A | 6/1994 |

(Continued)

OTHER PUBLICATIONS

Office Action issued in related Chinese patent application 201310445291.0, Jan. 6, 2015.

(Continued)

*Primary Examiner* — Justin Seo

(74) *Attorney, Agent, or Firm* — Merchant & Gould PC

(57) ABSTRACT

There is provided a recording apparatus including a first accommodating section, a transporting mechanism, a first path which includes a curved path portion, a second path which is extended linearly, a third path which includes a curved path portion, and a fourth path which is extended linearly, and a recording section. The transporting mechanism includes a guide surface extended linearly, which is configured to define the second path, and to guide one side end of the recording medium, and a pair of inclined feeding rollers which is configured to transport the recording medium with respect to the guide surface to bring the one side end of the recording medium to the guide surface. The recording section is arranged along the fourth path. The first accommodating section, the second path, and the fourth path are overlapped in a vertical direction.

15 Claims, 9 Drawing Sheets

(56) References Cited

FOREIGN PATENT DOCUMENTS

| | | | |
|---|---|---|---|
| JP | 2003-122072 | A | 4/2003 |
| JP | 2005-280132 | A | 10/2005 |
| JP | 2008-12890 | A | 1/2008 |
| JP | 2008-032913 | A | 2/2008 |
| JP | 2009-241355 | A | 10/2009 |
| JP | 2014-080293 | A | 5/2014 |

OTHER PUBLICATIONS

Office Action issued in related U.S. Appl. No. 14/039,280, Feb. 12, 2015.

* cited by examiner

RECORDING APPARATUS

CROSS REFERENCE TO RELATED APPLICATION

The present application claims priority from Japanese Patent Application No. 2012-218363, filed on Sep. 28, 2012, the disclosure of which is incorporated herein by reference in its entirety.

BACKGROUND OF THE INVENTION

1. Field of the Invention

The present invention relates to a recording apparatus which is configured to record an image on a recording medium.

2. Description of the Related Art

There is known an image forming apparatus having a side-register mechanism (positioning mechanism) which is arranged in a horizontal path including a recording position, at an upstream side in a transporting direction, of a recording position. In such image forming apparatus, since the side-register mechanism is arranged along the horizontal path, it is possible to carry out effectively the positioning of an end portion in a width direction of a recording medium.

SUMMARY OF THE INVENTION

If an arrangement in which the side-register mechanism is provided along a curved path connecting between a horizontal path and a paper feeding hopper which is a paper-accommodating section, the recording medium passing through the curved path is subjected to a force directed toward an outer side of the curved path. The force is generated when the curved recording medium regains an original form. Such force directed toward the outer side of the curved path with the recording medium trying to regain the original form is a reactive force which is developed due to a stiffness of the recording medium, or in other words, due to a pliability of the recording medium. Therefore, even when the recording medium is subjected to a force drawing toward one of the directions of width of the recording medium by the side-register mechanism, in some cases the recording medium is not drawn toward one of the directions of width due to the reactive force resisting the force applied, and it is not possible to carry out positioning of the end portion in the width direction of the recording medium. Therefore, it is desirable to provide the side-register mechanism along a straight-line path.

In the abovementioned image forming apparatus in which a horizontal path extending toward the recording position after the curved path is formed, and the side-register mechanism is provided along the horizontal path. Thus, it becomes necessary to form the horizontal path for arranging the side-register mechanism, between the curved path and the recording position, and a linear distance or a straight-line distance of the horizontal path including the recording position becomes large. Therefore, a footprint or an installation area of the image forming apparatus becomes large, and a problem of the installation area becoming large arises.

According to a first aspect of the present teaching, there is provided a recording apparatus configured to carry out recording on a recording medium, including:

a first accommodating section which is configured to accommodate the recording medium;

a transporting mechanism which is configured to transport the recording medium accommodated in the first accommodating section, in order of a first path which includes a curved path portion, a second path which is extended linearly, a third path which includes a curved path portion, and a fourth path which is extended linearly; and a recording section which is configured to record an image on the recording medium, wherein the transporting mechanism includes a guide surface extended linearly, which is configured to define the second path, and to guide one side end of the recording medium, and a pair of inclined feeding rollers which is configured to transport the recording medium with respect to the guide surface, to bring closer the one side end of the recording medium to the guide surface, and the recording section is arranged along the fourth path, and the first accommodating section, the second path, and the fourth path are overlapped in a vertical direction.

According to the first aspect of the present teaching, even when the inclined feeding roller and the guide surface for defining the second path are provided, or in other words, even when a member for positioning in a direction orthogonal to the transporting direction of the recording medium has been provided, since the first accommodating section, the second path, and the fourth path are overlapping in the vertical direction, it is possible to suppress the installation area of the apparatus from becoming large.

According to a second aspect of the present teaching, there is provided a recording apparatus configured to carry out recording on a recording medium, including:

a first accommodating section which is configured to accommodate the medium;

a transporting mechanism which is configured to transport the recording medium accommodated in the first accommodating section, in order of a first path which includes a curved path portion, a second path which is extended linearly, a third path which includes a curved path portion, and a fourth path which is extended linearly; and a recording section which is configured to record an image on the recording medium, wherein at least one of the first path and the third path includes a linear portion extending linearly along a vertical direction, and the transporting mechanism includes a guide surface extended linearly, which is configured to define the linear portion, and to guide one side end of the recording medium, and a pair of inclined feeding rollers which is configured to transport the recording medium with respect to the guide surface to bring closer the one side end of the recording medium to the guide surface, and the recording section is arranged along the fourth path, and the first accommodating section, the second path, and the fourth path are overlapped in a vertical direction.

According to the second aspect of the present teaching, even in a case in which, the pair of inclined feeding rollers and the guide surface for defining the linear portion are provided, since the linear portion is extended along the vertical direction, it is possible to suppress the installation area of the apparatus from becoming large.

According to the recording apparatus of the present teaching, it is possible to suppress the installation area of the apparatus from becoming large.

BRIEF DESCRIPTION OF THE DRAWINGS

FIG. 5A is a condition diagram when a feeding roller is in a pinched state, and FIG. 5B is a condition diagram when the feeding roller is in a released state;

DETAILED DESCRIPTION OF THE PREFERRED EMBODIMENTS

Exemplary embodiments of the present teaching will be described below while referring to the accompanying diagrams.

An overall arrangement of an ink-jet printer 1 as a first embodiment of a recording apparatus according to the present teaching, will be described below.

Figure 1:
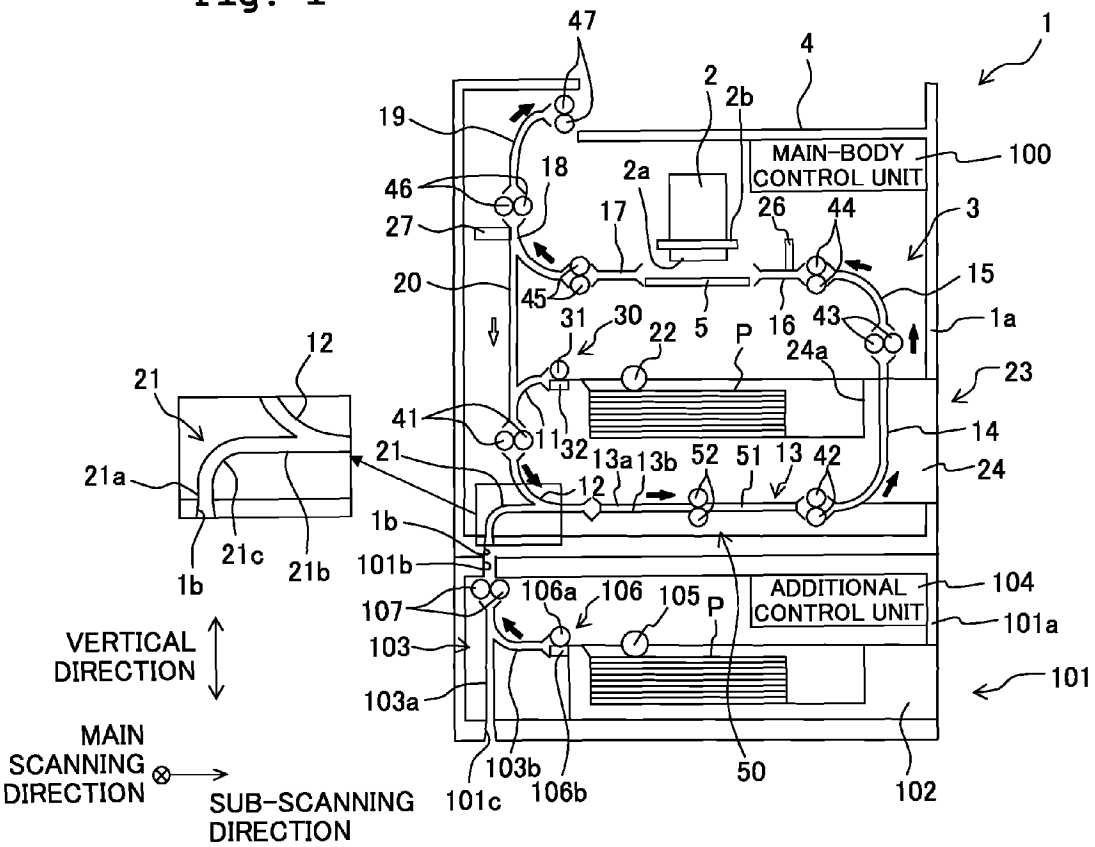
FIG. 1 is a schematic side view showing an internal structure of an ink-jet printer according to a first embodiment of a recording apparatus.

The ink-jet printer (hereinafter, referred to as a 'printer') 1 includes a housing 1*a* having a rectangular parallelepiped shape. An additional paper feeding unit 101 is installed at a lower end of the printer 1. The additional paper feeding unit 101 is detachable in a vertical direction from the printer 1. A paper discharge section 4 is provided to an upper portion of a top plate of the housing 1*a*. The paper discharge section 4 is an example of a discharge section according to the present teaching. A paper transporting path directed from a paper feeding section 23 toward the paper discharge section 4, a paper re-feeding path directed from a downstream side of the paper transporting path toward an upstream side of the paper transporting path, and a connecting path which is connected to an upstream portion of the paper transporting path are formed in an internal space of the housing 1*a*. A paper P, as shown in FIG. 1, is transported along black arrow marks in the paper transporting path, and is transported along white arrow marks in the paper re-feeding path.

A head 2 which is configured to jet a black ink, a transporting mechanism 3, the paper feeding section 23, and a main-body control unit 100 are arranged inside the housing 1*a*. The head 2 is an example of a recording section according to the present teaching. Moreover, a cartridge which is not shown in the diagram is installed inside the housing 1*a*. The black ink is stored in the cartridge. The cartridge is connected to the head 2 via a tube which is not shown in the diagram and a pump which is also not shown in the diagram, and the ink is supplied to the head 2.

The head 2 is a line head having a substantially rectangular parallelepiped shape with a longer side in a main scanning direction. A lower surface of the head 2 is a jetting surface 2*a* in which a plurality of jetting ports or nozzles open. At the time of recording, the black ink is jetted from the nozzles in the jetting surface 2*a*. The head 2 is supported by the housing 1*a* via a head holder 2*b*. The head holder 2*b* holds the head 2 such that a predetermined gap appropriate for recording is formed between the jetting surface 2*a* and the platen 5 which will be described later.

The transporting mechanism 3 includes eleven guide members 11 to 21, seven pairs of transporting rollers 41 to 47, the platen 5, a positioning mechanism 50, a separating mechanism 30, and a paper feeding roller 22. The paper feeding roller 22 is arranged at a position at which the paper feeding roller 22 makes a contact with the paper P which is at the top in a paper feeding tray 24 which will be described later. When the paper feeding roller 22 is driven by the main-body control unit 100, the paper feeding roller 22 feeds the paper P in the paper feeding tray 24. The platen 5 is arranged at a position facing the jetting surface 2*a*. The platen 5 which has a flat upper surface, supports the paper P from a lower side, and forms a recording area between the jetting surface 2*a* and the platen 5. The recording area is a part of the paper transporting path, and corresponds to a part of a fourth path.

The paper transporting path is formed by a first path, a second path, a third path, the fourth path, and a fifth path. The first path is a path which is defined by the two guide members 11 and 12, and has a path portion which is curved or bent from the paper feeding section 23 toward the second path. The first path is a path which is configured to guide the paper P transported from the paper feeding section 23 to be directed toward a leftward direction in FIG. 1, which is configured to guide the paper P to be directed toward a downward direction in FIG. 1, and thereafter, which is configured to guide the paper to be directed toward a rightward direction in FIG. 1. In other words, the first path is a path which is configured to guide the paper P transported from the paper feeding section 23 to take a U-turn. The second path is a path defined by the guide member 13, and is extended linearly along a sub-scanning direction. The second path is at a lower side of the paper feeding section 23. The transporting direction of the paper P in the second path is rightward in FIG. 1. The third path is a path that is defined by the two guide members 14 and 15, and has a path portion which is curved from the second path toward the fourth path. The third path is a path which is configured to guide the transporting paper P transported from the second path toward a rightward direction in FIG. 1, which is configured to guide toward an upward direction in FIG. 1, and thereafter, which is configured to guide toward a leftward direction in FIG. 1. In other words, the third path is a path which is configured to guide the paper P transported from the second path to take a U-turn. The fourth path is a path that is defined by the two guide members 16 and 17, the head 2, and the platen 5, and is extended linearly along the sub-scanning direction. The fourth path is at a position sandwiching the paper feeding section 23 between the second path and the fourth path. The transporting direction of the paper P in the fourth path is the leftward direction in FIG. 1, and is opposite to the transporting direction of the paper P in the second path. The fifth path is a path that is defined by the two guide members 18 and 19, and has a path portion which is curved from the fourth path toward the paper discharge section 4.

The paper re-feeding path is formed by a sixth path. The sixth path is a path that connects the fifth path and the second path, and is configured to guide the paper P transported from the fifth path to be directed toward the rightward direction in FIG. 1 after guiding toward the downward direction in FIG. 1. The sixth path is a path that goes around a recording area (between the platen 5 and the head 2), and is defined by the guide member 20, a part of the guide member 11, and the guide member 12. The guide member 20 is connected to a site at some mid-point of the guide member 11. In such manner, a part of the sixth path and a part of the first path are a common path.

The pair of transporting rollers 41 is arranged at some mid-point of the first path, and between the guide member 11 and the guide member 12. The pair of transporting rollers 42 is arranged at a location where the second path and the third path are connected, and between the guide member 13 and the guide member 14. The pair of transporting rollers 43 is arranged at some mid-point of the third path, and between the guide member 14 and the guide member 15. The pair of transporting rollers 44 is arranged at a location where the third path and the fourth path are connected, and between the guide member 15 and the guide member 16. The pair of transporting rollers 45 is arranged at a location where the fourth path and the fifth path are connected, and between the guide member 17 and the guide member 18. The pair of transporting rollers 46 is arranged at some mid-point of the fifth path, and between the guide member 18 and the guide member 19. The pair of transporting rollers 47 is arranged between the guide member 19 and the paper discharge section 4. These seven pairs of transporting rollers 41 to 47 are driven by a control of the main-body control unit 100. Accordingly, the paper P is transported in order from the first path to the fifth path, and is discharged to the paper discharge section 4.

At the pair of transporting rollers 46, the transporting direction of the paper P is switched by the control of the main-body control unit 100. The pair of transporting rollers 46 is an example of a pair of re-feeding rollers according to the present teaching. In other words, in a case of transporting the paper P from the recording area to the paper discharge section 4, the pair of transporting rollers 46 rotates such that the paper P is transported upward. On the other hand, in a case of transporting the paper P from the paper transporting path to the paper re-feeding path, a direction of rotation of the pair of transporting rollers 46 is switched such that, a rear end of the paper P is transported downward as a leading end. Here, the switching of the direction of rotation of the pair of transporting rollers 46 is carried out when the rear end of the paper P is between a location at which the guide member 18 and the guide member 20 are connected, and the pair of transporting rollers 46, and when detected by a paper sensor 27, the rear end of the paper P is transported downward as a leading end. The paper P which has been transported from the paper transporting path to the paper re-feeding path is re-fed to the second path. At this time, the paper P to be re-fed is transported once again to the recording area with being turned upside down, as compared with the paper P which has passed a recording area immediately before. In such manner, it is possible to record an image on both surfaces of the paper P.

The separating mechanism 30 includes a feeding roller 31 and a friction member 32. The feeding roller 31 makes a contact with an upper surface of the paper P which has been fed by the paper feeding roller 22. The friction member 32 is arranged at a position facing the feeding roller 31, on a lower side of the feeding roller 31, and makes a contact with a lower surface of the paper P that has been fed by the paper feeding roller 22. The feeding roller 31 rotates in one direction by the control of the main-body control unit 100. In the first embodiment, the feeding roller 31 rotates in a clockwise direction in FIG. 1. Moreover, a bias in a downward direction, or in other words, a bias toward the friction member 32, is applied to the feeding roller 31 by a bias applying mechanism which is not shown in the diagram. Therefore, the feeding roller 31 is capable of transporting the paper P that has been fed between the feeding roller 31 and the friction member 32, and that makes a contact with the feeding roller 31, to the first path. It is preferable that the friction member 32 is formed of a member having a high coefficient of friction, such as cork and rubber.

In this arrangement, even when a plurality of papers P is fed in a multi-ply state by the paper feeding roller 22, by the rotation of the paper feeding roller 22 and the feeding roller 31 controlled by the main-body control unit 100, the paper P that has made a contact with the paper feeding roller 22 is transported to the first path mainly by the feeding roller 31. At this time, another paper P which is under the paper P and which is multi fed is subjected to friction resistance, by the friction member 32, in a direction opposite to the transporting direction in which the paper P is transported by the feeding roller 31. The friction resistance in this case is also called as a transporting resistance. Therefore, only one paper P out of the plurality of the multi fed papers P is transported to the first path.

Figure 2:
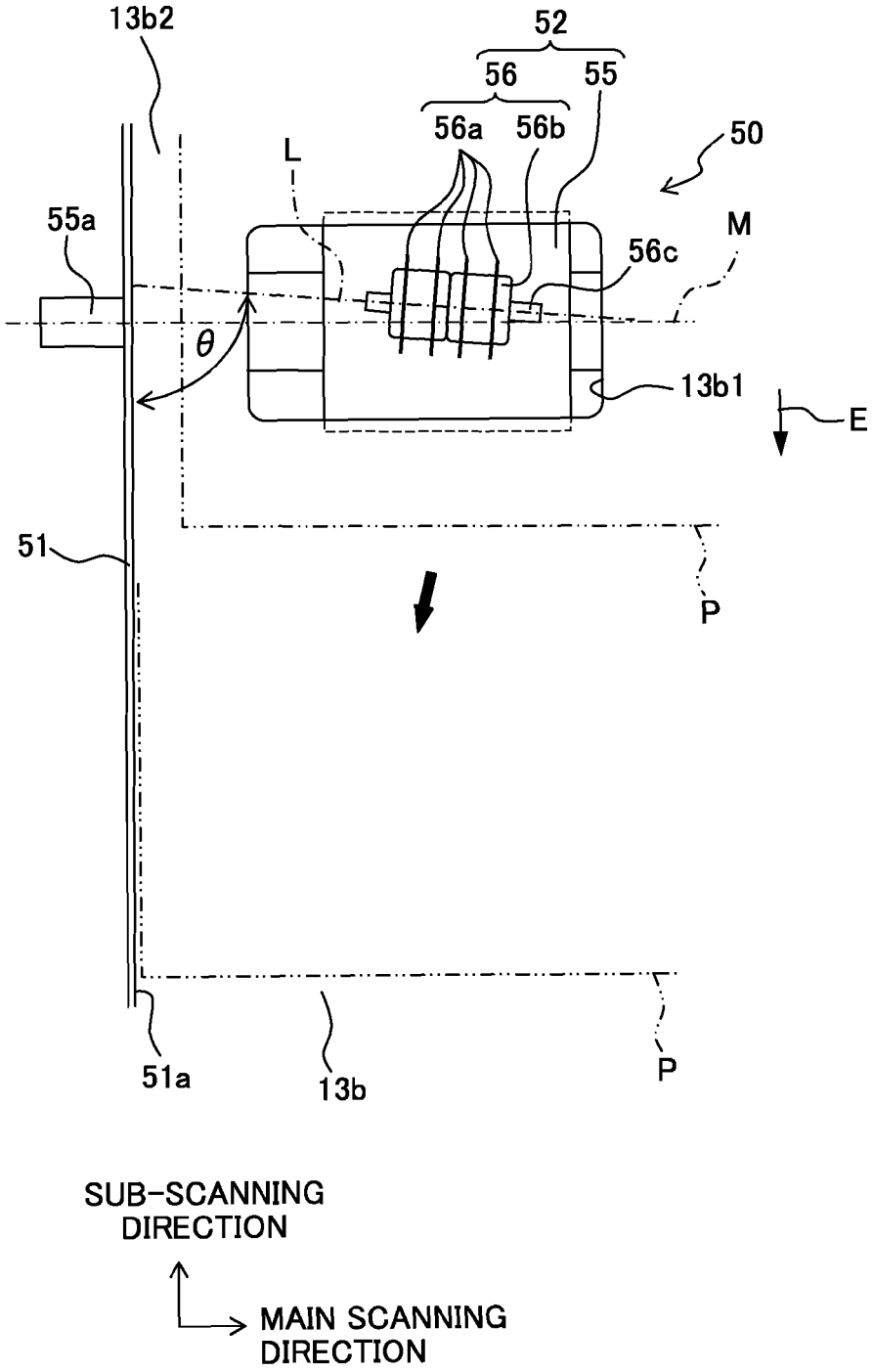
FIG. 2 is a plan view of main components of a positioning mechanism shown in FIG. 1.

The positioning mechanism 50, as shown in FIG. 1 and FIG. 2, includes a pair of inclined feeding rollers 52 and a vertical portion 51 formed on a lower guide 13*b* of the guide member 13. The guide member 13 includes an upper guide 13*a* and the lower guide 13*b*, and the upper guide 13*a* and the lower guide 13*b* are arranged to be mutually isolated in the vertical direction. The second path is defined between the upper guide 13*a* and the lower guide 13*b*. The upper guide 13*a* and the lower guide 13*b* are extended linearly along a horizontal direction. Moreover, the second path is also defined by a guide surface 51*a* of the vertical portion 51. The positioning mechanism 50 carries out the positioning of the paper P in the width direction by transporting one end in the width direction of the paper P that has been transported to the second path, while making it abut with the guide surface 51*a* (which will be described later). In the first embodiment, the width direction means the main scanning direction which is a direction orthogonal to the transporting direction E of the paper P (refer to FIG. 2). Here, the one end in the width direction of the paper P is an end on a side nearer to the guide surface 51*a*, out of the two ends in the width direction of the paper P.

The vertical portion 51 is formed to be erected in the vertical direction from a left end in FIG. 2, which is one end in the main scanning direction of the lower guide 13*b*. The vertical portion 51 is extended along the sub-scanning direction. In other words, the vertical portion 51 is extended linearly along the horizontal direction. The guide surface 51*a* which is a vertical surface of which in-plane direction is parallel to the sub-scanning direction is formed on the vertical portion 51. That is, the guide surface 51*a* is parallel to the sub-scanning direction. The guide surface 51*a* is a side surface of the vertical portion 51 which is on the other end side, out of the two side surfaces in the main scanning direction of the vertical portion 51. A length in the sub-scanning direction of the guide surface 51*a* is almost same as a length of the paper P in the sub-scanning direction. Moreover, a hole 13*b*1 is formed in the lower guide 13*b* as shown in FIG. 2. The hole 13*b*1 has a substantial rectangular shape in a plan view, and a planar size thereof is larger than a drive roller 55 which will be described later, in the main scanning direction, and is slightly smaller than the driver roller 55 in the sub-scanning direction. Moreover, a hole which is not shown in the diagram is formed also in the upper guide 13*a*, and a lower-side portion of a spur roller 56 which will be described later, can be exposed to the second path through the hole not shown in the diagram.

The pair of inclined feeding rollers 52 includes the drive roller 55 and the spur roller 56 which faces the drive roller 55. The spur roller 56 is a driven roller which rotates with the transporting of the paper P that is transported by the drive roller 55 or by the rotation of the drive roller 55. The drive roller 55, as shown in FIG. 2, is arranged at a position facing the hole 13*b*1. The drive roller 55 is arranged such that an upper end thereof is slightly protruded upward from a transporting surface 13*b*2 of the lower guide 13*b*, and makes a contact with a lower surface of the paper P that has been transported on to the transporting surface 13*b*2. A shaft portion 55*a* of the drive roller 55 is rotatably supported by the housing 1*a*. The drive roller 55 is arranged such that an axis M of the shaft portion 55*a* becomes parallel to the main scanning direction. The positioning mechanism 50 has a drive motor which is not shown in the diagram. The drive motor is driven by the control of the main-body control unit 100, and rotates the drive roller 55 via the shaft portion 55*a*.

The spur roller 56 has four spurs 56*a* that are annular-shaped, and a roller main-body 56*b* having a circular cylindrical shape with the spur 56*a* fixed to an outer peripheral side surface thereof. A shaft portion 56*c* that becomes an axis of rotation (pivot shaft) of the spur roller 56 is formed on two end surfaces of the roller main body 56*b*. The spur roller 56 is rotatably supported by the upper guide 13*a*. The spur roller 56 is arranged such that an angle θ made by a portion at a downstream side in the transporting direction of the guide surface 51*a* of a point of intersection of an axis L of the shaft portion 56*c* and the guide surface 51*a*, and the axis L is in a range of 85° to 90°, and is more preferably 88°. Thus, it is preferable that the angle θ is an acute angle.

In this arrangement, as the paper P is transported to the positioning mechanism 50 by passing through the second path by the pair of transporting rollers 41, and a front end of the paper P reaches the pair of inclined feeding rollers 52, the paper P is pinched by a pair of inclined feeding rollers 53, and transported. At this time, the drive roller 55 makes an attempt to transport the paper P in the transporting direction E. Since the axis L of the spur roller 56 is inclined, the paper P is transported in a direction inclined with respect to the transporting direction E as shown by an alternate long and two short dashes line. In other words, the paper P is transported in a direction shown by an arrow in FIG. 2, and a direction of approaching the guide surface 51*a*. Accordingly, an overall left-edge of the paper P is transported in the transporting direction E while making a contact with the guide surface 51*a*. At this time, the paper P is transported in the transporting direction E, while the left edge of the paper P making a contact with the guide surface 51*a*. Therefore, it is possible to carry out positioning of the paper P in the main scanning direction.

The transporting mechanism 3 has a hole 1*b* formed in a lower surface of the housing 1*a*. The hole 1*b* is an example of a receiving opening 1*b* according to the present teaching. The hole 1*b* is an opening for receiving the paper P that has been transported from the additional paper feeding unit 101. The connecting path is a path which connects the hole 1*b* and the second path, and is defined by a part of the guide member 12 and the guide member 21. The guide member 21 is connected to a site at some mid-point of the guide member 12. In such manner, a part of the connecting path and a part of the first path are a common path. More elaborately, the part of the connecting path and a part of the sixth path are a common path.

The guide member 21 includes a vertical portion 21*a* that is extended upward from the hole 1*b*, a linear portion 21*b* that is extended along the sub-scanning direction, and a curved portion 21*c* that connects the vertical portion 21*a* and the linear portion 21*b*. The linear portion 21*b* is formed such that the connecting path has a portion which is positioned linearly in the same manner as the second path. The printer 1 according to the present embodiment is capable of recording an image on both surfaces of the paper P. The paper P having an image formed on one surface thereof is transported to the second path upon passing through the paper re-feeding path. At this time, when there is a jamming in the paper re-feeding path, sometimes an ink is adhered to a guide on a side facing the one side of the paper P on which the image is recorded, out of the pair of guides which form the guide member 12. Moreover, when there is a jamming at the upstream portion of the pair of inclined feeding rollers 52 of the second path, since the one surface of the paper P on which the image is recorded is facing the upper guide 13*a*, sometimes the ink is adhered to the upper guide 13*a*. In such manner, the connecting path includes a linear path which is collinear with the second path. Therefore, even when a dirt is adhered to one of the pair of guides which forms the guide member 12 of the paper re-feeding path, or to an upstream portion of the pair of inclined feeding rollers 52 of the upper guide 13*a*, the ink adhered to the paper re-feeding path or the second path (in other words, the upper guide 13*a*) is not susceptible to be adhered to the paper P. Concretely, the paper that has been transported from the additional paper feeding unit 101 passes through the curved portion 21*c*. While passing through the curved portion 21*c*, the paper P regains or restores to an original state spontaneously. In other words, the paper P regains a flat state when stacked in a paper feeding tray 102, and a reactive force directed toward an outer side of the curved portion 21*a* is developed. In other words, the paper P transported through the curved portion 21*c* is transported while the front end of the paper P is abutted with an outer-side guide of the curved portion 21*c*. Next, the paper P transported from the curved portion 21*c* is introduced to the second path after passing the linear path. Here, by the front end of the paper P being passed through the linear path, the reactive force is suppressed, and the paper P is drawn toward a lower side due to a weight of the front end of the paper P. Therefore, when the paper P passes through the second path, the front end of the paper P comes closer to the lower guide 13*b* than to the upper guide 13*a*, and the paper P is not susceptible to make a contact with the upper guide 13*a*. Therefore, dirt of the second path is not susceptible to be adhered to the paper P. Supposedly, if the paper P is introduced to the paper re-feeding path immediately after the curved path 21*c*, due to the reactive force of the paper P, the paper P is transported such that the front end of the paper P abuts with one of the pair of guides forming the guide member 12 of the paper re-feeding path, or such that the paper P abuts with a portion of the upper guide 13*a* at an upstream of the pair of inclined feeding rollers 52. In other words, in a case in which the linear portion 21*b* does not exist, the dirt is susceptible to be adhered to the paper P. Moreover, a straight-line portion defined by the linear portion 21*b* is shorter than a length of the guide surface 51*a*, in the sub-scanning direction. More elaborately, it is preferable that the straight-line portion has a length of about few centimeters, and has a length such that the front end of the paper P that has passed through the curved portion 21*c* is isolated from an outer-side portion, or in other words, an upper-side portion of the guide member 21. The guide surface 51*a* carries out a function of positioning the paper P. Therefore, longer the length in the sub-scanning direction of the guide surface 51*a*, better is the positioning performance. Therefore, it is preferable that the length in the sub-scanning direction of the guide surface 51*a* is not less than one third of the length of the paper P in the sub-scanning direction. In other words, since it is preferable that the straight-line portion defined by the linear portion 21*b* is shorter than the length of the guide surface 51*a* in the sub-scanning direction, it is possible to suppress an installation area of the printer 1 from becoming large.

Figure 3:
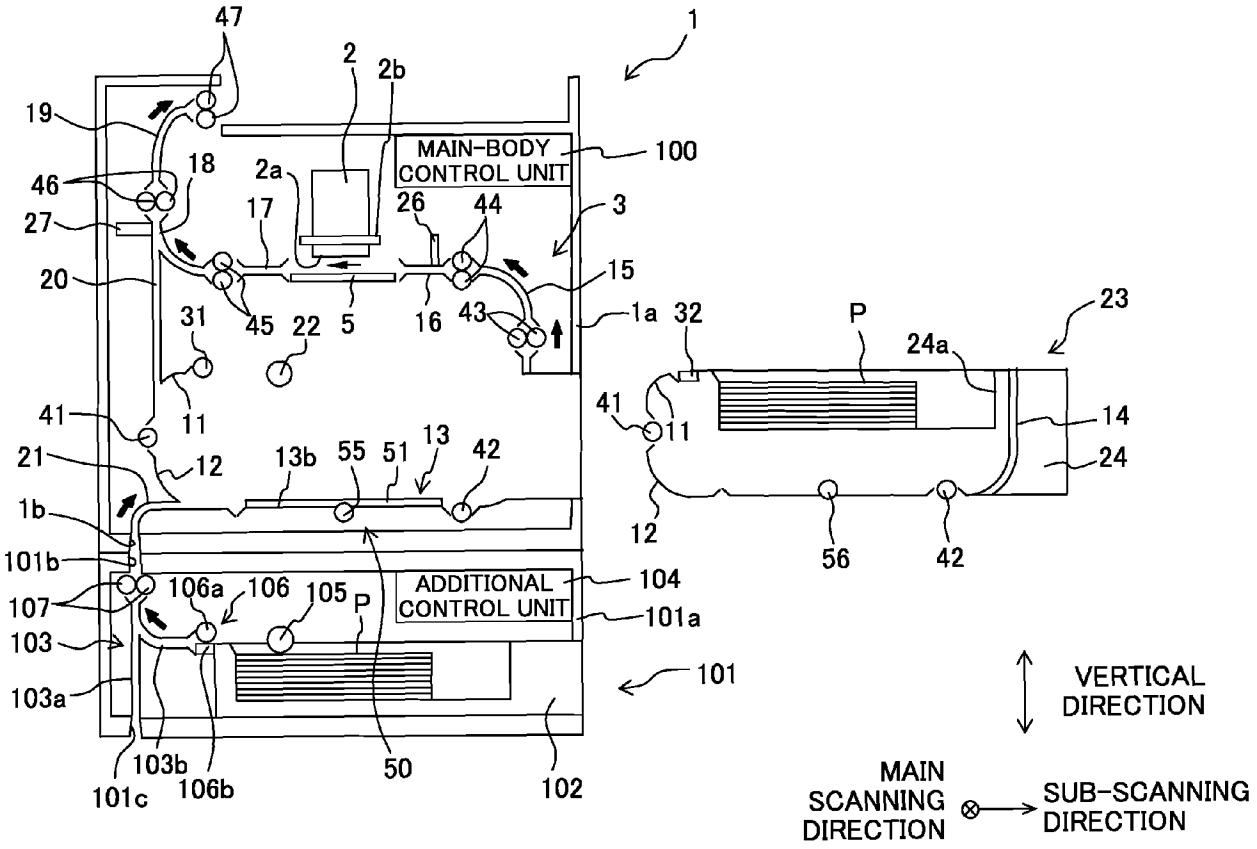
FIG. 3 is a condition diagram when a paper feeding tray has been removed from a housing.

The paper feeding section 23, as shown in FIG. 3, has the paper feeding tray 24 which is detachable in the sub-scanning direction from the housing 1*a*. The paper feeding tray 24 is a box having a recess 24*a* opening upward, and is capable of accommodating the plurality of papers P in the recess 24*a*. A part of the guide members 11 and 12, and one transporting roller of the pair of transporting rollers 41 are provided to a left-end portion of the paper feeding tray 24 as shown in FIG. 3. Concretely, a guide on a side nearer to the paper feeding tray 24 out of the pair of guides which form the guide members 11 and 12, and a roller on a side nearer to the paper feeding tray 24 out of the two rollers which form the pair of transporting rollers 41 are provided to the left-end portion of the paper feeding tray 24. A roller on a side nearer to the paper feeding tray 24 out of the two rollers which form the pair of transporting rollers 42, the spur roller 56, and the upper guide 13*a* are provided to a lower-end portion of the paper feeding tray 24. A pair of guides which forms a part of the guide member 14 is provided to a right-end portion of the paper feeding tray 24. Moreover, the friction member 32 is provided to a left-end portion of an upper surface of the paper feeding tray 24. The paper feeding tray 24 may be detachable in the main scanning direction from the housing 1*a*. In that case, a guide on a side nearer to the paper feeding tray 24 out of the pair of guides which form the part of the guide member 14 may be provided to the right-end portion of the paper feeding tray 24.

In such manner, the upper guide 13*a* and a part of the guide members 11 and 12 which define the first path and the second path, a part of the guide member 14 which defines the third path are provided integrally to the paper feeding tray 24. Therefore, the first path, the second path, and the third path are exposed to exterior when the paper feeding tray 24 is removed from the housing 1*a* as shown in FIG. 3. Therefore, even when there is a jamming in the first path, the second path, and the third path, it is possible to remove the paper P easily.

The additional paper feeding unit 101, as shown in FIG. 1, has a housing 101*a*. The paper feeding tray 102, a guide section 103, and an additional control unit 104 are arranged in the housing 101*a*. The paper feeding tray 102 is detachable from the housing 101*a*. The plurality of papers P can be accommodated in the paper feeding tray 102. Based on a command from the main-body control unit 100, the additional control unit 104 controls an operation of each of a paper feeding roller 105, a separating mechanism 106, and a pair of transporting rollers 107 of the guide section 103. A contact point which is not shown in the diagram, but is connected to the main-body control unit 100 is provided to a lower surface of the housing 1*a* and a contact point which is not shown in the diagram, but is connected to the additional control unit 104 is provided to an upper surface of the housing 101*a*. When the additional paper feeding unit 101 is to be installed in the printer 1, the abovementioned contact points are connected electrically, and the main-body control unit 100 and the additional control unit 104 are connected.

A discharge hole 101*b* is formed in the upper surface of the housing 101*a*. The discharge hole 101*b* is arranged at a position facing the hole 1*b*, and is an opening for discharging the paper P to the hole 1*b*. Moreover, a hole 101*c* having a shape similar to the hole 1*b* is formed in a lower surface of the housing 101*a*.

The guide section 103 includes two guide members 103*a* and 103*b*, the paper feeding roller 105, the separating mechanism 106, and the pair of transporting rollers 107. The paper feeding roller 105 feeds the paper P at the top in the paper feeding tray 102. The separating mechanism 106 has an arrangement similar to the separating mechanism 30, and includes a feeding roller 106*a* and a friction member 106*b*. Accordingly, it is possible to transport to the guide member 103*b*, only one paper P out of the plurality of papers P which is multi fed by the paper feeding roller 105.

The pair of transporting rollers 107 is arranged near the discharge hole 101*b* so that the paper P can be transported toward the discharge hole 101*b*. The guide member 103*a* is extended from the hole 101*c* up to the pair of transporting rollers 107, and forms a transporting path between the hole 101*c* and the pair of transporting rollers 107. The guide member 103*b* is extended from the paper feeding tray 102 up to a site at some mid-point of the guide member 103*a*, and forms a transporting path between the paper feeding tray 102 and the site at some mid-point of the guide member 103*a*. According to such an arrangement, the guide section 103 transports the paper P from the paper feeding tray 102 and the paper P from another additional paper feeding unit, toward the printer 1. In other words, the guide section 103 transports the paper P from a lower side toward the upper side.

Next, the main-body control unit 100 and the additional control unit 104 will be described below. The main-body control unit 100 controls an operation of the overall printer 1 by controlling an operation of each section of the printer 1. The main-body control unit 100 controls a recording operation based on a recording command which has been supplied from an external device such as a PC connected to the printer 1. Concretely, the main-body control unit 100 controls operations such as an operation of transporting the paper P and an ink-jetting operation which is synchronized with the transporting of paper P. The additional control unit 104 controls the operation of transporting the paper P based on a command from the main-body control unit 100.

In a case in which a recording command for carrying out recording on one surface of the paper P has been received from an external device for instance, the main-body control unit 100 drives the paper feeding roller 22, the feeding roller 31, the pairs of transporting rollers 41 to 47, and the pair of inclined feeding rollers 52, based on the recording command received. The paper P fed from the paper feeding tray 24 is transported from the first path to the second path, and the positioning of the paper P in the main scanning direction is carried out by the positioning mechanism 50. At this time, the main-body control unit 100 drives the pair of transporting rollers 41 such that a transporting velocity V1 of the paper P transported by the pair of transporting rollers 41 becomes slightly faster than a transporting velocity V2 of the paper P transported by the pair of inclined feeding rollers 52, or in other words, the relationship between V1 and V2 satisfies V1>V2. Accordingly, at the time of transporting the paper P obliquely by the pair of inclined feeding rollers 52, no back-tension due to the pair of transporting rollers 41 is applied to the paper P. Therefore, it is possible to prevent defective transporting by the pair of inclined feeding rollers 52, and also it is possible to transport obliquely the paper P effectively. As a result, it is possible to transport the paper P positioned in the main scanning direction to the recording area. Next, the paper P is transported from the second path to the recording area, or in other words, between the platen 5 and the head 2, of the fourth path, via the third path. When the paper P passes right beneath the head 2, the head 2 is controlled by the main-body control unit 100, and ink droplets are jetted from the head 2. Accordingly, a desired image is recorded on a surface of the paper P. An operation of jetting the ink, such as a timing of jetting the ink, is based on a detection signal from a paper sensor 26. The paper sensor 26 is arranged at an upstream side in the transporting direction of the head 2, and detects the front end of the paper P. Next, the paper P having the image recorded thereon is discharged from the fifth path to the paper discharge section 4.

Moreover, in a case in which the main-body control unit 100 has received a recording command for recording on both surfaces of the paper P from an external device for example, the main-body control unit 100 drives the paper feeding roller 22, the feeding roller 31, the pairs of transporting rollers 41 to 47, and the pair of inclined feeding rollers 52, based on the recording command. Firstly, similarly as at the time of one-sided recording, an image is formed on a front surface of the paper P, and the paper P is then transported toward the paper discharge section 4. As shown in FIG. 1, the paper sensor 27 is arranged near an upstream side of the pair of transporting rollers 46, of the guide member 18 which is at some mid-point of transporting. As the paper sensor 27 detects the rear end of the paper P, the pair of transporting rollers 46 is rotated in reverse direction under the control of the main-body control unit 100, and a direction of transporting of the paper P is reversed. At this time, in a case in which the pair of transporting rollers 41 has not been driven, the main-body control section 100 drives the pair of transporting rollers 41. Accordingly, the paper P has its path switched, and is transported along the paper re-feeding path. The paper re-feeding path is shown by a white arrow mark in the diagram. The paper P which has been transported to the paper re-feeding path, similarly as at the time of one-sided recording, is subjected to positioning in the main-scanning direction, in the second path. Even at the time of positioning in this case, since no back-tension due to the pair of transporting rollers 41 is applied to the paper P, it is possible to transport obliquely the paper P, effectively. Moreover, a recording surface of the paper P which has been re-fed from the paper re-feeding path to the second path is turned upside down. In other words, a recording surface of the paper P when the paper P has been transported from the paper feeding tray 24 to the second path is directed to be facing downward. Still in other words, a surface on which an image is to be recorded is facing downward. However, a recording surface of the paper P when the paper P has been re-fed from the paper re-feeding path to the second path is directed to be facing upward. In other words, a surface on which an image has been recorded is facing upward. Moreover, when the paper P passes through the second path and the third path, the paper P is fed once again to the recording area in a state that the paper P is turned upside down. Accordingly, an image is recorded on the rear surface of the paper P. Prior to the image recording on the rear surface of the paper P, as the leading end of the paper P is detected by the paper sensor 26, the pair of the transporting rollers 46 is returned to the normal rotation. The paper P subjected to double-sided recording is discharged to the discharge section 4 via the fifth path.

In a case of supplying the paper P from the additional paper feeding unit 101 instead of the paper feeding section 23, and recording an image on one side or both sides of the paper P, the additional control unit 104 drives the paper feeding roller 105, the feeding roller 106*a*, and the pair of transporting rollers 107, based on a command from the main-body control unit 100. At this time, the main-body control unit 100 drives the paper feeding roller 22, the feeding roller 31, the pair of transporting rollers 42 to 47 except for the pair of transporting rollers 41, and also drives the pair of inclined-feeding rollers 52. For the rest of the operation, a control similar to the abovementioned control is carried out.

As it has been described above, according to the printer 1 of the first embodiment, even when the pair of inclined feeding rollers 52 and the guide surface 51*a* for defining the second path are provided, the paper feeding section 23, the second path, and the fourth path are arranged to be overlapped in the vertical direction. In other words, in the printer 1 of the first embodiment, even when the positioning mechanism 50 is provided, the paper feeding section 23, the guide member 13, the guide members 16 and 17, the platen 5, and the head 2 are arranged to be overlapped in the vertical direction. Therefore, it is possible to suppress the installation area of the printer 1 from becoming large.

The fourth path, the paper feeding section 23, and the second path are arranged in this order from the upper side. Therefore, the paper feeding section 23 is arranged between the second path and the fourth path, and it is possible to make large a radius of curvature of the third path which connects the second path and the fourth path. Consequently, it is possible to suppress the jamming of the paper P in the transporting path while suppressing the height of the printer 1 from becoming large.

Moreover, the sixth path which is the paper re-feeding path, connects the fifth path and the second path. Therefore, it is possible to record an image on both surfaces of the paper P. Furthermore, it is possible to carry out positioning of the paper P in the main scanning direction even before recording an image on the rear surface of the paper P.

Moreover, the printer 1 has the guide member 21 which defines the connecting path that has been connected from the hole 1*b* up to the second path. Therefore, it is possible to transport the paper P transported from the additional paper feeding unit 101 to the recording area after positioning.

Moreover, since the printer 1 has the separating mechanism 30, it is possible to prevent multi feeding of the paper P from the paper feeding tray 24. The pair of transporting rollers 41 is provided between the separating mechanism 30 and the pair of inclined feeding rollers 52 in the transporting direction of the paper P. Accordingly, since it is possible to reduce an effect of a comparatively strong transporting load due to the separating mechanism 30, it is possible to prevent defective transporting by the pair of inclined feeding rollers 52.

Figure 4:
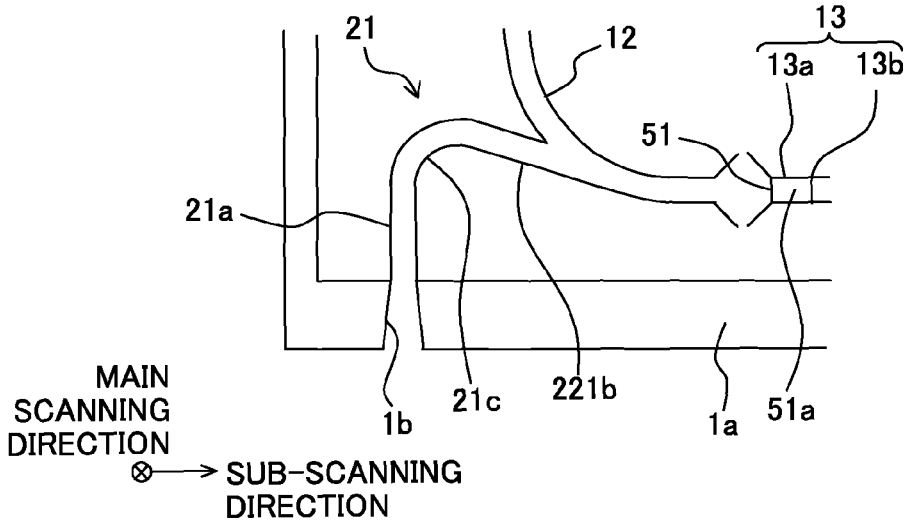
FIG. 4 is an enlarged view showing a modification of a guide member which defines a connecting path of the recording apparatus.

As a modified embodiment, a linear portion 221*b* of the guide member 21 may be extended to be directed downward with moving closer to the second path as shown in FIG. 4. The guide member 21 is an example of a connecting path defining portion according to the present teaching. In other words, a downstream end in the transporting direction of a portion which the curved portion 21*c* of the connecting path defines, is arranged on an upper side of the second path, and the linear portion 221*b* is extended in a straight line toward the second path which is in an inclined-right downward direction from the downstream end. Even in this case, the ink adhered to the paper re-feeding path or the second path (in other words, the upper guide 13*a*) is not susceptible to be adhered to the paper P. In other words, the paper P that has been transported from the additional paper feeding unit 101 is introduced to the second path after passing through the path defined by the linear portion 221*b*. At this time, when the leading end of the paper P passes through the path, the leading end is drawn forcibly toward the lower side. Therefore, when passing through the second path, the front end of the paper P comes closer to the lower guide 13*b* than to the upper guide 13*a*, and the paper P is not susceptible to make a contact with the upper guide 13*a*. Therefore, the dirt of the second path is not susceptible to be adhered to the paper P.

Figure 5B:
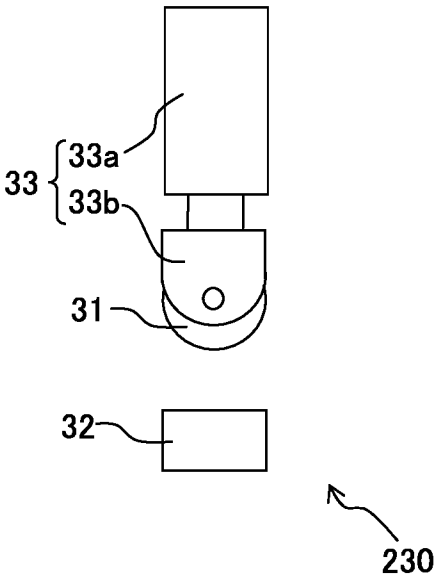
FIG. 5A and FIG. 5B show modification of a separating mechanism of the recording medium according to the present invention where.
Figure 5A:
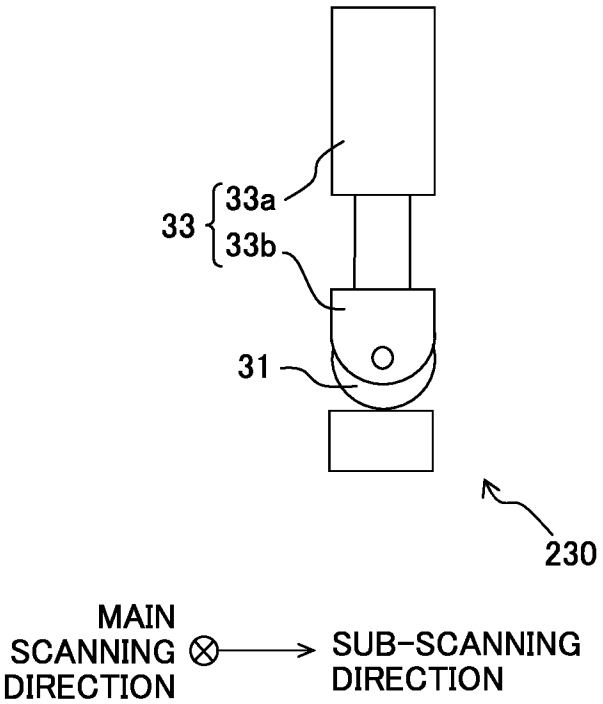

As another modified embodiment, instead of having the separating mechanism 30, the printer 1 may have a separating mechanism 230 which includes the feeding roller 31, the friction member 32, and a moving mechanism 33 which moves the feeding roller 31 with respect to the friction member 32, as shown in FIG. 5. The moving mechanism 33 has a solenoid 33*a*, and a supporting portion 33*b* which supports the feeding roller 31. The supporting portion 33*b* is connected to a movable iron core of the solenoid 33*a*. The solenoid 33*a* of the moving mechanism 33 is activated by the control of the main-body control unit 100. Accordingly, the moving mechanism 33 moves the feeding roller 31 between a pinched state (a state in which the paper P is pinched) and a released state (a state in which the paper P is released and not pinched any more). The pinched state, as shown in FIG. 5A, is a state in which the feeding roller 31 and the friction member 32 make a mutual contact through the paper P, and is a state in which the paper P is pinched. The feeding roller 31 is arranged in the pinched state. Therefore, it is possible to transport the paper P that is fed between the feeding roller 31 and the friction member 32, and the paper P that makes a contact with the feeding roller, to the first path. The released state, as shown in FIG. 5B, is a state in which the feeding roller 31 and the friction member 32 are isolated, and is a state in which the paper P is not pinched.

In such arrangement, suppose that the paper feeding roller 22 and the feeding roller 31 rotate in a state of the feeding roller 31 arranged in the pinched state by the control of the main-body control unit 100, and that the plurality of papers P is multi fed from the paper feeding roller 22. Even in such case, the paper P which has made a contact with the paper feeding roller 22 is transported by the feeding roller 31 to the first path similarly as in the abovementioned embodiment. In other words, one paper P from among the plurality of papers P that is multi fed is transported to the first path. Moreover, the main-body control unit 100, while transporting the paper P at the time of recording an image on one surface or both surfaces, moves the feeding roller 31 to the released state when the leading end of the paper P has reached the pair of inclined feeding rollers 52. In other words, the main-body control unit 100 releases the pinching of the rear end portion of the paper P. Accordingly, at the time of inclined-feeding the paper P by the pair of inclined feeding rollers 52, no back-tension due to the separating mechanism 230 is applied to the paper P. Therefore, it is possible to prevent defective transporting by the pair of inclined feeding rollers 52, and also it is possible to feed obliquely the paper P effectively. In a case in which such separating mechanism 230 is provided, the pair of transporting rollers 41 as a pair of intermediate rollers for suppressing the back-tension of the separating mechanism 230 may not be provided. Moreover, in the present modified embodiment, the moving mechanism 33 moves the feeding roller 31. However, an arrangement may have been made such that the moving mechanism 33 moves the friction member 32 and not the feeding roller 31.

Figure 6:
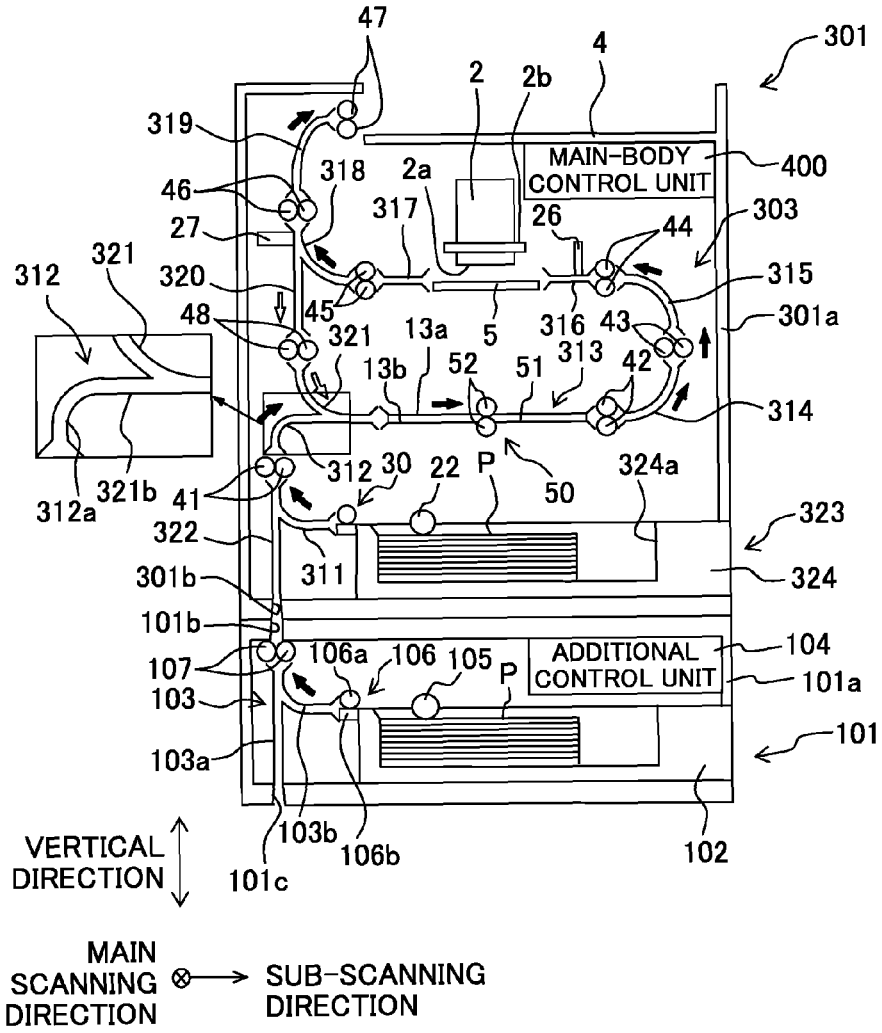
FIG. 6 is a schematic side view showing an internal structure of an ink-jet printer according to a second embodiment of the recording apparatus.

Next, a printer 301 according to a second embodiment of the recording apparatus according to the present teaching will be described below while referring to FIG. 6. The printer 301 according to the second embodiment is a printer in which a positional relationship of components such as the paper feeding section 23 and the guide member 31 which defines the second path in the abovementioned embodiment has been changed. Since the rest of the arrangements are similar to the abovementioned arrangement of the printer 1, the components which are same are indicated by the same reference numerals, and description of such components is omitted.

The printer 301 includes a housing 301*a* having a rectangular parallelepiped shape. The additional paper feeding unit 101 is installed at a lower end of the printer 301. A paper transporting path that is directed from a paper feeding section 323 toward the paper discharge section 4, a paper re-feeding path that is directed from a downstream side of the paper transporting path to an upstream side of the paper transporting path, and a connecting path that is connected to an upstream portion of the paper transporting path are formed in an internal space of the housing 301*a*. As shown in FIG. 6, the paper P is transported along black arrow marks in the paper transporting path, and is transported along white arrow marks in the paper re-feeding path.

The head 2, a transporting mechanism 303, the paper feeding section 323, and a main-body control unit 400 are arranged inside the housing 301*a*. The transporting mechanism 303 includes twelve guide members 311 to 322, the eight pairs of transporting rollers 41 to 48, the platen 5, the positioning mechanism 50, the separating mechanism 30, and the paper feeding roller 22. The paper feeding section 323 includes a paper feeding tray 324 which is detachable in the sub-scanning direction from the housing 301*a*. The paper feeding tray 324 is a box having a recess 324*a* that opens upward, and is capable of accommodating the plurality of papers P in the recess 324*a*. The paper feeding roller 22 feeds the paper P which is at the top of the papers P stacked in the paper feeding tray 324. The guide members 313 and 315 to 319 are similar to the aforementioned guide members 13 and 15 to 19, respectively.

The paper transporting path is formed by a first path, a second path, a third path, a fourth path, and a fifth path. The first path is a path which is defined by the two guide members 311 and 312, and is curved or bent from the paper feeding section 323 to be directed toward the second path. The second path is similar as in the aforementioned embodiment, except for being arranged at an upper side of the paper feeding section 323. The third path is a path which is defined by the two guide members 314 and 315, and is curved from the second path to be directed toward the fourth path. The fourth path and the fifth path are similar as in the aforementioned embodiment. The fourth path is at a position sandwiching the second path between the paper feeding section 323 and the fourth path.

The paper re-feeding path is formed by a sixth path. The sixth path is a path that connects the fifth path and the second path, going around the recording area, or in other words, between the platen 5 and the head 2, and is defined by a part of the guide member 312, and the guide members 320 and 321. The guide member 321 is connected to a site at some mid-point of the guide member 312. In such manner, a part of the sixth path and a part of the first path are a common path.

The pair of transporting rollers 41 is arranged at some mid-point of the first path, and between the guide member 311 and the guide member 312. The pairs of transporting rollers 42 to 47 are arranged to have positional relationship same as in the aforementioned embodiment (the first embodiment). These seven pairs of transporting rollers 41 to 47 are driven by the control of the main-body control unit 400. Accordingly, the paper P is transported in order from the first path to the fifth path, and is discharged to the paper discharge section 4.

The pair of transporting rollers 48 is arranged at some mid-point of the sixth path, between the guide member 320 and the guide member 321. Similarly as in the aforementioned embodiment, under the control of the main-body control unit 400, the pair of transporting rollers 46 switches the transporting direction of the paper P. The paper P, which has been transported by the pair of transporting rollers 46 such that the rear end of the paper P becomes the leading end, is re-fed to the second path by the pair of transporting rollers 48. At this time, the paper P to be re-fed is transported to the second path in a state of being turned upside down as compared with a state when the paper P has passed through the recording area immediately before. As a result, it is possible to record an image on both surfaces of the paper P.

The transporting mechanism 303 has a hole 301*b* formed in a lower surface of the housing 301*a*. The hole 301*b* is an opening for receiving the paper P that has been transported from the additional paper feeding unit 101. The connecting path is a path which connects the hole 301*b* and the second path, and is defined by the guide member 322, a part of the guide member 311, and the guide member 312. The guide member 322 is connected to a site at some mid-point of the guide member 311. In such manner, a part of the connecting path and a part of the first path are a common path. More elaborately, a part of the connecting path and a part of the sixth path are a common path.

The guide member 312 has a curved portion 312*a* and a linear portion 312*b* that is extended along the sub-scanning direction. The linear portion 312*b*, similarly as the aforementioned linear portion 21*b*, is formed to have a linear portion such that, the first path is positioned to be collinear with the second path. The linear portion is arranged at an upstream side of the connecting portion of the second path and the sixth path with respect to the transporting direction of the paper P. Even in the second embodiment, the first path has a linear path which is collinear with the second path similarly as in the aforementioned embodiment. Therefore, the ink adhered to the paper re-feeding path or the ink adhered to the second path, or in other words, the ink adhered to the upper guide 13*a*, is not susceptible to be adhered to the paper P. In other words, the paper P that has been transported from the paper feeding tray 324 and the additional paper feeding unit 101 is introduced to the second path after passing through the linear path. At this time, the front end of the paper P is drawn toward a lower side by being passed through the linear path. Therefore, the paper P is not susceptible to make a contact with the upper guide 13*a*, and dirt of the second path is not susceptible to be adhered to the paper P.

Next, the main-body control unit 400 and the additional control unit 104 will be described below. The main-body control unit 400 controls an operation of the overall printer 301 by controlling an operation of each section of the printer 301. The main-body control unit 400, controls the recording operation based on a recording command which has been supplied from an external device such as a PC connected to the printer 301, for instance. Concretely, the main-body control unit 400 controls operations such as the operation of transporting the paper P and the ink-jetting operation which is synchronized with the transporting of paper P. The additional control unit 104 controls the operation of transporting the paper P based on a command from the main-body control unit 400.

In a case in which a recording command for carrying out recording on one surface of the paper P has been received from an external device for instance, the main-body control unit 400 drives the paper feeding roller 22, the feeding roller 31, the pairs of transporting rollers 41 to 47, and the pair of inclined feeding rollers 52, based on the recording command received. The paper P fed from the paper feeding tray 324 is transported from the first path to the second path, and the positioning of the paper P in the main scanning direction is carried out by the positioning mechanism 50. At this time, the main-body control unit 400 drives the pair of transporting rollers 41 such that the transporting velocity V1 of the paper P transported by the pair of transporting rollers 41 is slightly faster than a transporting velocity V2 of the paper P transported by the pair of inclined feeding rollers 52, or in other words, the relationship between V1 and V2 satisfies V1>V2. Accordingly, it is possible to prevent defective transporting by the pair of inclined feeding rollers 52, and it is possible to feed obliquely the paper P, effectively, similarly as in the aforementioned embodiment. As a result, it is possible to transport to the recording area, the paper P for which the positioning in the main scanning direction has been carried out. Next, the paper P is transported from the second path to the recording area, or in other words, to an area between the platen 5 and the head 2 of the fourth path via the third path. When the paper P passes right beneath the head 2, the head 2 is controlled by the main-body control unit 400, and ink droplets are jetted from the head 2. Accordingly, a desired image is recorded on a front surface of the paper P. The operation of jetting the ink, such as the timing of jetting the ink, is based on a detection signal from the paper sensor 26. The paper sensor 26 is arranged at an upstream side in the transporting direction of the head 2, and detects the front end of the paper P. Next, the paper P having the image recorded thereon is discharged from the fifth path to the paper discharge section 4.

Moreover, in a case in which the main-body control unit 400 has received a recording command for recording on both surfaces of the paper P from an external device for example, the main-body control unit 400 drives the paper feeding roller 22, the feeding roller 31, the pairs of transporting rollers 41 to 47, and the pair of inclined feeding rollers 52, based on the recording command. Firstly, similarly as at the time of one-sided recording, the paper P, upon having an image formed on the front surface thereof, is transported toward the paper discharge section 4. As shown in FIG. 6, the paper sensor 27 is arranged on the guide member 318 which is at some mid-point of transporting, near an upstream side of the pair of transporting rollers 46. As the paper sensor 27 detects the rear end of the paper P, the pair of transporting rollers 46 is rotated in reverse direction under the control of the main-body control unit 400, and the direction of transporting of the paper P is reversed. At this time, the main-body control unit 400 drives the pair of transporting rollers 48. Accordingly, the path of the paper P is switched, and the paper P is transported along the paper re-feeding path shown by a white arrow mark in the diagram. The paper P which has been transported to the paper re-feeding path, similarly as at the time of one-sided recording, is subjected to positioning in the main-scanning direction, in the second path. At this time, the main-body control unit 400 drives the pair of transporting rollers 48 such that the transporting velocity V1 of the paper P transported by the pair of transporting rollers 48 is slightly faster than the transporting velocity V2 of the paper P transported by the pair of inclined feeding rollers 52, or in other words, the relationship between V1 and V2 satisfies V1>V2. Accordingly, since there is no back-tension applied to the paper P by the pair of transporting rollers 48 even at the time of positioning in this case, it is possible to feed obliquely the paper P, effectively. Moreover, a recording surface of the paper P which has been re-fed from the paper re-feeding path to the second path is turned upside down. In other words, a recording surface (a surface on which an image is to be recorded) of the paper P when the paper P has been transported from the paper feeding tray 324 to the second path is directed downward. However, when the paper P has been re-fed from the paper re-feeding path to the second path, a recording surface of the paper P is directed to be facing upward. In other words, a surface, on which an image is to be recorded, of the paper P that has been transported from the paper feeding tray 324 to the second path is facing downward, but a surface on which an image has been recorded, of the paper P that has been re-fed from the paper re-feeding path to the second path is facing upward. Moreover, when the paper passes through the second path and the third path, the paper P is re-fed to the recording area after the paper P is turned upside down, and an image is recorded on a rear surface of the paper P. Prior to the image recording on the rear surface, as the leading end of the paper P is detected by the paper sensor 26, the pair of transporting rollers 46 is returned to normal rotation. The paper P subjected to double-sided recording is discharged to the discharge section 4 via the fifth path.

In a case of supplying the paper P from the additional paper feeding unit 101 instead of the paper feeding section 323, and recording an image on one side or both sides of the paper P, the additional control unit 104 drives the paper feeding roller 105, the feeding roller 106*a*, and the pair of transporting rollers 107, based on a command from the main-body control unit 400. At this time, the main-body control unit 400 does not drive the paper feeding roller 22 and the feeding roller 31. For the rest of the operation, a control similar to the aforementioned control is carried out.

As it has been described above, according to the printer 1 of the present embodiment, even when the pair of inclined feeding rollers 52 and the guide surface 51*a* for defining the second path are provided, the paper feeding section 323, the second path, and the fourth path are arranged to be overlapped in a vertical direction. Or in other words, according to the printer 1 in the present embodiment, even when the positioning mechanism 50 is provided, the paper feeding section 323, the guide member 313, the guide members 316 and 317, the platen 5, and the head 2 are arranged to be overlapped in a vertical direction. Therefore, similarly as in the aforementioned embodiment, it is possible to suppress the installation area of the printer 1 from becoming large.

The fourth path, the second path, and the paper feeding section 323 are arranged in this order from the upper side. Accordingly, it is possible to share the paper feeding tray 324 and the paper feeding tray 102 commonly.

Moreover, the sixth path which is the paper re-feeding path, connects the fifth path and the second path. Therefore, it is possible to record an image on both surfaces of the paper P. Furthermore, it is possible to carry out positioning of the paper P in the main scanning direction also before recording an image on the rear surface of the paper P.

Figure 7:
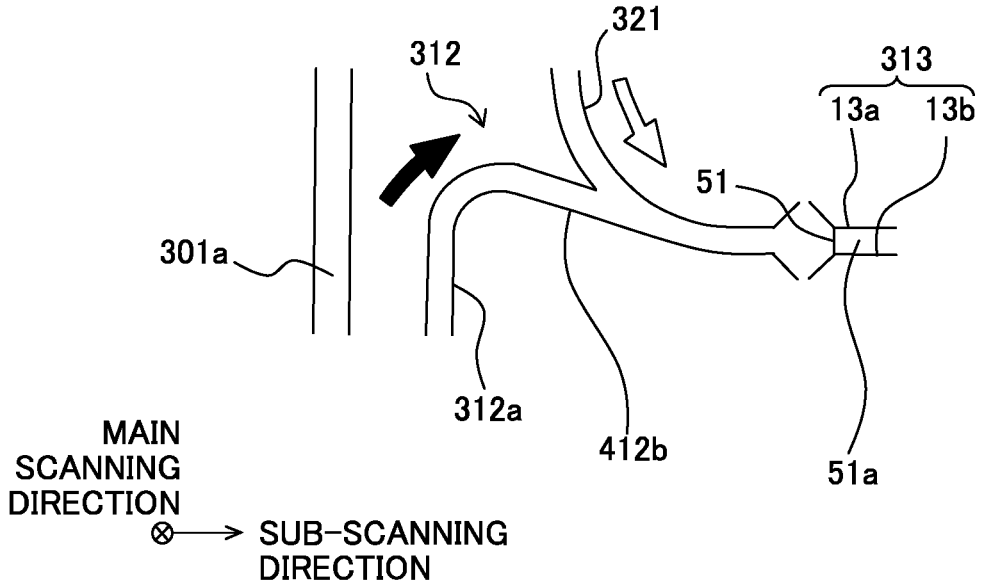
FIG. 7 is an enlarged view showing a modification of a guide member which defines a connection path according to the second embodiment of the recording apparatus.

As a modified embodiment, a linear portion 412*b* of the guide member 312 may be extended to be directed downward with moving closer to the second path as shown in FIG. 7. The guide member 312 is an example of the first defining portion according to the present teaching. In other words, a downstream end in the transporting direction of a portion which the curved portion 312*a* defines, is arranged on an upper side of the second path, and the linear portion 412*b* is extended in a straight line toward the second path which is in an inclined-right downward direction from the downstream end. Even in this case, the ink adhered to the paper re-feeding path or the second path, or in other words, the ink adhered to the upper guide 13*a* is not susceptible to be adhered to the paper P. In other words, the paper P that has been transported from the paper feeding tray 324 and the additional paper feeding unit 101 is introduced to the second path after passing through the path defined by the linear portion 412*b*. At this time, the leading end of the paper P, by passing through the path, is drawn forcibly toward the lower side. Therefore, when passing through the second path, the front end of the paper P comes closer to the lower guide 13*b* than to the upper guide 13*a*, and the paper P is not susceptible to make a contact with the upper guide 13*a*. Therefore, the dirt of the second path is not susceptible to be adhered to the paper P.

Figure 8:
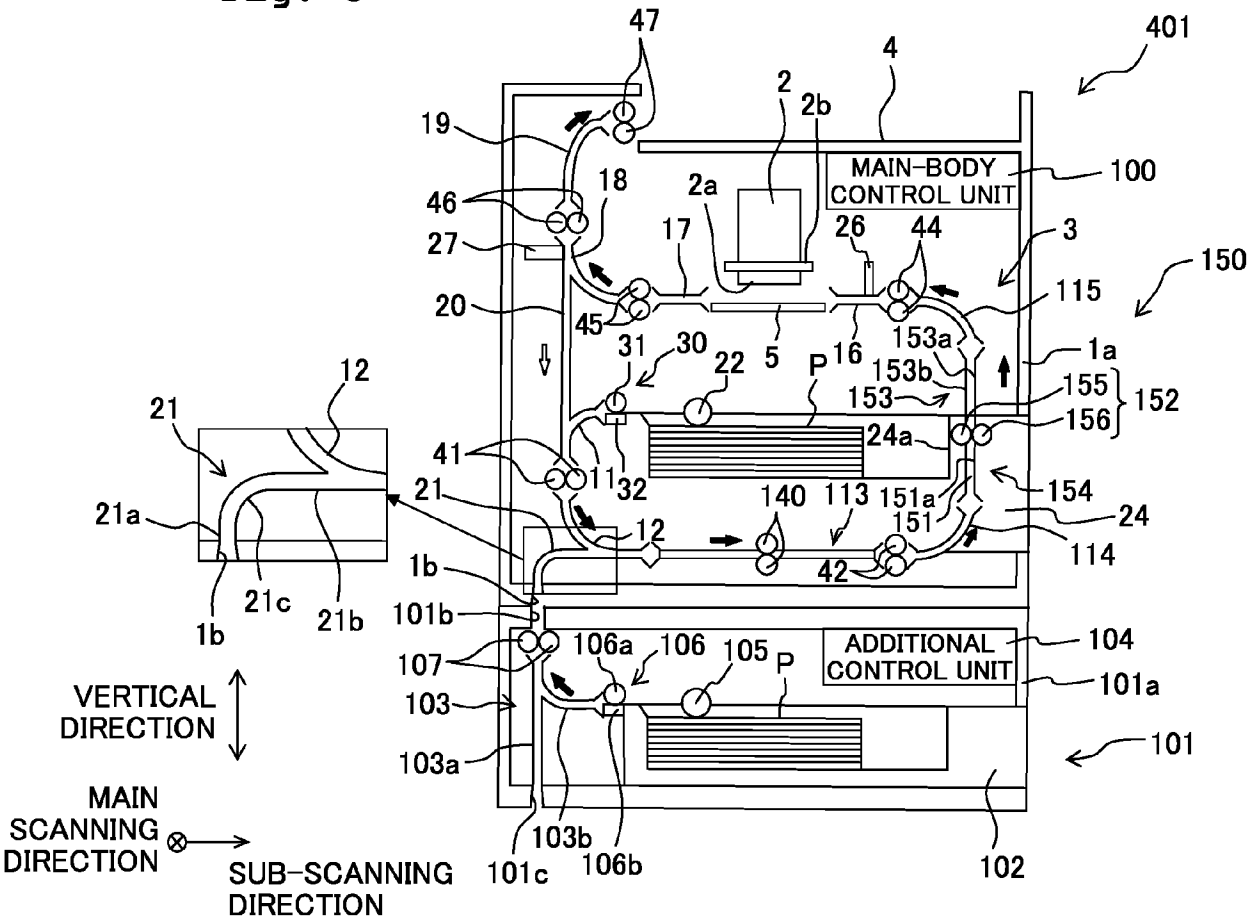
FIG. 8 is a schematic side view showing an internal structure of an ink-jet printer according to a third embodiment of the recording apparatus.

Next, a printer 401 as a third embodiment of the recording apparatus according to the present teaching will be described below while referring to FIG. 8. The printer 401 of the third embodiment is a printer in which the positioning mechanism 50 in the first embodiment is provided to the third path, and not to the second path as in the first embodiment. The printer 401 of the third embodiment has an arrangement similar to the printer 1 of the first embodiment except for an arrangement of the second path and the third path. Therefore, same reference numerals are assigned to components which are similar as in the first embodiment, and the description of such components is omitted.

The second path is a path that is defined by a guide member 113, and is extended linearly along the sub-scanning direction. Moreover, a pair of transporting rollers 140 is provided at a site at some mid-point of the guide member 113. The pair of transporting rollers 140 transports the paper P that has been transported to the second path, along the transporting direction. In the third embodiment, the pair of transporting rollers 140 transports the paper P that has been transported to the second path, toward a rightward direction in FIG. 8.

The third path is a path that is defined by three guide members 114, 115, and 153, and has a path portion which is curved or bent from the second path toward the fourth path. The third path is a path that guides the paper P to be directed upward in FIG. 8, after transporting the paper P transported from the second path, to be directed rightward in FIG. 8, and thereafter, guides the paper P to be directed leftward in FIG. 8. In other words, the third path is a path which guides the paper P that has been transported from the second path, such that the paper P makes a U-turn. Moreover, the third path has a linear portion 154 which is extended linearly along the vertical direction. The linear portion 154 is a path that is defined by the guide member 153, and a positioning mechanism 150 is provided to the linear portion 154. The positioning mechanism 150 has a vertical portion 151 that is formed on a first guide 153*a* of the guide member 153, and a pair of inclined feeding rollers 152. The guide member 153 has the first guide 153*a* and a second guide 153*b*, and the first guide 153*a* and the second guide 153*b* are arranged to be mutually isolated in the horizontal direction. The third path is defined between the first guide 153*a* and the second guide 153*b*. The first guide 153*a* and the second guide 153*b* are extended linearly along the vertical direction. Moreover, the third path is also defined by a guide surface 151*a* of the vertical portion 151. The positioning mechanism 150 transports the paper P that has been transported to the third path, while making abut one end in a width direction of the paper P with the guide surface 151*a*. Accordingly, positioning of the paper P in the width direction is carried out. The width direction of the paper P is the main scanning direction which is a direction orthogonal to the transporting direction E of the paper P. Moreover, the one end in the width direction of the paper P in this case, is an end which is nearer to the guide surface 151*a*, out of the two ends in the width direction of the paper P.

The vertical portion 151 is formed to be erected in the vertical direction from the main scanning direction of the first guide 153*a*. The vertical portion 151 is extended linearly along the vertical direction. Since an arrangement of the guide member 153 is same as the arrangement of the guide member 13 in the first embodiment except for a point that an angle of installation is different, the description in detail thereof is omitted.

The pair of inclined feeding rollers 152 includes a drive roller 155 and a spur roller 156 which is facing the drive roller 155. The pair of inclined feeding rollers 152 transports the paper P upward in the vertical direction.

In this arrangement, when the paper P is transported to the positioning mechanism 150 (second path) by the pair of transporting rollers 42, and when the front end of the paper reaches the pair of inclined feeding rollers 152, the paper P is pinched by the inclined feeding rollers 152 and transported. At this time, since the paper P is transported in the transporting direction while a side end of the paper P making a contact with the guide surface 151*a*, it is possible to carry out positioning of the paper P in the main scanning direction.

As it has been described above, according to the printer 401 of the third embodiment, even in a case in which the pair of inclined feeding rollers 152 and the guide surface 151*a* for defining the linear portion of the third path have been provided, or in other words, even in a case in which the positioning mechanism 150 has been provided, the linear portion 154 is extended along the vertical direction. Therefore, it is possible to suppress the installation area of the printer 401 from becoming large.

As a modified embodiment of the third embodiment, the positioning mechanism may be provided to the first path, and not to the third path. In this case, the first path has a linear portion that is extended linearly along the vertical direction, and the positioning mechanism is to be provided to the linear portion.

Figure 9:
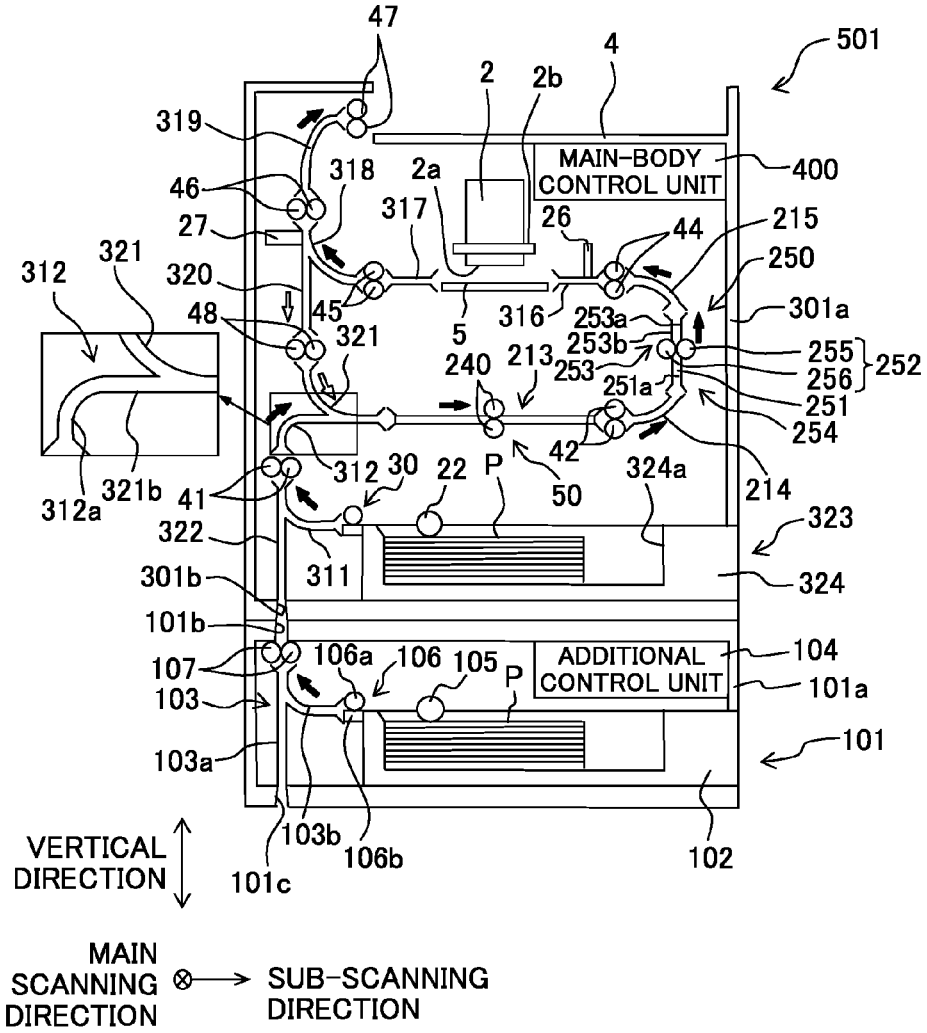
FIG. 9 is a schematic side view showing an internal structure of an ink-jet printer according to a fourth embodiment of the recording apparatus.

Next, a printer 501 as a fourth embodiment of the recording apparatus according to the present teaching will be described below while referring to FIG. 9. The printer 501 of the fourth embodiment is a printer in which the positioning mechanism 50 in the first embodiment is provided to the third path, and not to the second path as in the first embodiment. The printer 501 of the fourth embodiment has an arrangement similar to the printer 1 of the first embodiment except for an arrangement of the second path and the third path. Therefore, same reference numerals are assigned to components which are similar as in the first embodiment, and the description of such components is omitted.

The second path is a path that is defined by a guide member 213, and is extended linearly along the sub-scanning direction. Moreover, a pair of transporting rollers 240 is provided at a site at some mid-point of the guide member 213. The pair of transporting rollers 240 transports the paper P that has been transported to the second path, along the transporting direction. In the fourth embodiment, the pair of transporting rollers 240 transports the paper P that has been transported to the second path, toward a rightward direction in FIG. 9.

The third path is a path that is defined by three guide members 214, 215, and 253, and has a path portion which is curved from the second path toward the fourth path. The third path is a path that guides the paper P to be directed upward in FIG. 9, after transporting the paper P transported form the second path, to be directed rightward in FIG. 9, and thereafter, guides the paper P to be directed leftward in FIG. 9. In other words, words, the third path is a path which guides the paper P, that has been transported from the second path, such that the paper P makes a U-turn. Moreover, the third path has a linear portion 254 which is extended linearly along the vertical direction. The linear portion 254 is a path that is defined by the guide member 253, and a positioning mechanism 250 is provided to the linear portion 254. The positioning mechanism 250 has a vertical portion 251 that is formed on a first guide 253*a* of the guide member 253, and a pair of inclined feeding rollers 252. The guide member 253 has the first guide 253*a* and a second guide 253*b*, and the first guide 253*a* and the second guide 253*b* are arranged to be mutually isolated in the horizontal direction. The third path is defined between the first guide 253*a* and the second guide 253*b*. The first guide 253*a* and the second guide 253*b* are extended linearly along the vertical direction. Moreover, the third path is also defined by a guide surface 251*a* of the vertical portion 251. The positioning mechanism 250 transports the paper P that has been transported to the third path, while making abut one end in a width direction of the paper P with the guide surface 251*a*. Accordingly, positioning of the paper P in the width direction is carried out. The width direction of the paper P is the main scanning direction, and is a direction orthogonal to the transporting direction E of the paper P. Moreover, the one end in the width direction of the paper P in this case, is an end which is nearer to the guide surface 251*a*, out of the two ends in the width direction of the paper P.

The vertical portion 251 is formed to be erected in the vertical direction from the main scanning direction of the first guide 253*a*. The vertical portion 251 is extended linearly along the vertical direction. Since an arrangement of the guide member 253 is same as the arrangement of the guide member 313 in the second embodiment except for a point that the angle of installation is different, the description in detail thereof is omitted.

The pair of inclined feeding rollers 252 includes a drive roller 255 and a spur roller 256 which is facing the drive roller 255. The pair of inclined feeding rollers 252 transports the paper P upward in the vertical direction.

In this arrangement, when the paper P is transported to the positioning mechanism 250 (second path) by the pair of transporting rollers 42, and when the front end of the paper reaches the pair of inclined feeding rollers 252, the paper P is pinched by the inclined feeding rollers 252 and transported. At this time, since the paper P is transported in the transporting direction while a side end of the paper P making a contact with the guide surface 251*a*, it is possible to carry out positioning of the paper P in the main scanning direction.

As it has been described above, according to the printer 501 of the fourth embodiment, even in a case in which the pair of inclined feeding rollers 252 and the guide surface 251*a* for defining the linear portion of the third path have been provided, or in other words, even in a case in which the positioning mechanism 250 has been provided, the linear portion 254 is extended along the vertical direction. Therefore, it is possible to suppress the installation area of the printer 501 from becoming large.

As a modified embodiment of the fourth embodiment, the positioning mechanism may be provided to the first path, and not to the third path. In this case, the first path has a linear portion that is extended linearly along the vertical direction, and the positioning mechanism is to be provided to the linear portion.

The exemplary embodiments of the present teaching have been described heretofore. However, the present invention is not restricted to the aforementioned embodiments, and various modifications are possible within the range of the patent claims. For instance, in the printers 1 and 301 of the embodiments, the paper re-feeding path has been provided. However, the paper re-feeding path may not be provided. Moreover, in the printers 1 and 301 of the embodiments, the holes 1*b* and 301*b* which receive the paper P from the additional paper feeding unit 101, and the connecting paths which are connected to the holes 1*b* and 301*b* respectively may not be provided. In this case, to use the absence of the connecting paths effectively, an installation area of the printers 1 and 301 may be made smaller. Moreover, the linear portions 21*b*, 221*b*, 312*b*, and 412*b* may not be provided. Furthermore, the separating mechanism 30 may not be provided. The separating mechanism may be provided with a retard roller instead of the friction member. Moreover, the pair of transporting rollers 41 as an intermediate roller may not be provided between the inclined feeding roller and the separating mechanism in the transporting direction. Furthermore, the transporting velocity V1 of the paper P transported by the pair of transporting rollers 41 may be slower than or same as the transporting velocity V2 of the paper P transported by the pair of inclined feeding rollers 52. Moreover, the part of the guide member 11, the part of the guide member 12, and the upper guide 13*a* may not be provided integrally to the paper feeding tray 24. Furthermore, the paper feeding tray 24 may have been provided to the housing 1*a*, to be detachable in the main scanning direction.

In each of the aforementioned embodiments and the modified embodiments, the spur roller 56 has been used. However, it may be a rubber roller or a resin roller without a protrusion. Moreover, a bead roller having a plurality of protrusions on an outer peripheral side surface thereof may be used. The above-mentioned guide surface 51*a* is a vertical surface which is parallel to the sub-scanning direction. However, the guide surface 51*a* may be inclined with respect to the vertical surface in a direction which is orthogonal to the transporting direction E.

The embodiments and the modified embodiments described heretofore can be combined appropriately according to the requirement.

The present teaching is applicable to both of a line head and a serial head. Moreover, the present invention is not restricted to a printer and is also applicable to apparatuses such as a facsimile and a copy machine. Furthermore, the present teaching is also applicable to a recording apparatus such as of a laser type, provided that it is a recording apparatus that records an image. The recording medium is not restricted to the paper P, and may be various recordable media such as an OHP (overhead projector) sheet.

What is claimed is:

1. A recording apparatus comprising:

a first accommodating section which is configured to accommodate a recording medium;

a transporting mechanism which is configured to transport the recording medium accommodated in the first accommodating section, in order of a first path which includes a curved path portion, a second path which is extended linearly, a third path which includes a curved path portion, and a fourth path which is extended linearly; and a recording section which is configured to record an image on the recording medium, wherein the transporting mechanism includes a guide surface extended linearly, which is configured to define the second path, and to guide one side end of the recording medium, and a pair of inclined feeding rollers which is configured to transport the recording medium with respect to the guide surface, to bring closer the one side end of the recording medium to the guide surface, and the recording section is arranged along the fourth path, and the first accommodating section, the second path, and the fourth path are overlapped in a vertical direction, wherein the fourth path, the first accommodating section, and the second path are arranged in order from an upper side.

2. The recording apparatus according to claim 1, further comprising:

a discharge section which is configured such that a recording medium on which the recording is carried out by the recording section is discharged to the discharge section, wherein the transporting mechanism includes a fifth path defining portion which defines a fifth path connecting the fourth path and the discharge section, a sixth path defining portion which defines a sixth path connecting the fifth path and the second path, and a pair of re-feeding rollers which is configured to transport the recording medium to the second path via the sixth path, upon inverting a transport direction of the recording medium such that a rear end of the recording medium that has been transported to the fifth path becomes a leading end in the transport direction.

3. The recording apparatus according to claim 2, wherein a detachable unit including a second accommodating section configured to accommodate the recording medium is detachable from the recording apparatus, and is arranged at a lower side of the first accommodating section, to be overlapped in the vertical direction with the first accommodating section, and the transporting mechanism includes a receiving opening which is formed to receive the recording medium that has been transported from the second accommodating section, and a connecting path defining portion which defines a connecting path connecting the receiving opening and the second path.

4. The recording apparatus according to claim 3, wherein the connecting path defining portion defines the connecting path such that, the connecting path has a portion which is positioned to be collinear with the second path.

5. The recording apparatus according to claim 4, wherein a length of a portion positioned collinear with the second path is shorter than a length by which the guide surface is extended.

6. The recording apparatus according to claim 3, wherein the connecting path defining portion defines the connecting path such that the connecting path has a portion extended to be directed further downward as the connecting path is closer to the second path.

7. The recording apparatus according to claim 1, wherein the transporting mechanism includes a separating mechanism which is configured to transport upon separating the plurality of recording media which has been multi transported from the first accommodating section.

8. The recording apparatus according to claim 7, wherein the transporting mechanism has a pair of transporting rollers which has been arranged to transport the recording medium while pinching the recording medium between the separating mechanism and the pair of inclined feeding rollers, in a transporting direction in which the recording medium is transported.

9. The recording apparatus according to claim 8, wherein a transporting velocity of the recording medium by the pair of transporting rollers is faster than a transporting velocity of the recording medium by the pair of inclined feeding rollers.

10. The recording apparatus according to claim 7, wherein the separating mechanism includes a feeding roller which is configured to rotate while making a contact with the recording medium to transport the recording medium in the transporting direction, a resistance applying portion which is arranged at a position facing the feeding roller, and which applies to the recording medium a resistance in a direction opposite to the transporting direction, and a moving mechanism which is configured to move one of the feeding roller and the resistance applying portion between a pinched state in which the recording medium is pinched, and a released state in which the pinching of the recording medium is released, and the recording apparatus further comprising:

a controller which is configured to control the moving mechanism to release pinching of the recording medium by the feeding roller and the resistance applying portion when a leading end in the transporting direction of the recording medium has reached the pair of inclined feeding rollers.

11. The recording apparatus according to claim 1, further comprising:

a housing which is configured to accommodate the first accommodating section, the transporting mechanism, and the recording section, wherein the first accommodating section is configured to be detachable from the housing, and the transporting mechanism includes a first path defining portion which defines the first path, a second path defining portion which defines the second path, and a third path defining portion which defines the third path, and at least a part of each of the first path defining portion, the second path defining portion, and the third path defining portion is provided integrally to the first accommodating section.

12. The recording apparatus according to claim 1, wherein the fourth path, the second path, and the first accommodating section are arranged in order from the upper side.

13. The recording apparatus according to claim 12, further comprising:

a discharge section which is configured such that a recording medium on which the recording is carried out by the recording section is discharged to the discharge section, wherein the transporting mechanism includes a fifth path defining portion which defines a fifth path connecting the fourth path and the discharge section, a sixth path defining portion which defines a sixth path connecting the fifth path and the second path, and a pair of re-feeding rollers which is configured to transport the recording medium to the second path via the sixth path, upon inverting a transport direction of the recording medium such that a rear end of the recording medium that has been transported to the fifth path becomes a leading end in the transport direction.

14. The recording apparatus according to claim 13, wherein the transporting mechanism includes a first path defining portion which defines the first path, and the first path defining portion defines the first path such that the first path has a portion which is positioned to be collinear with the second path, at an upstream side in the transporting direction of the recording medium, than a connecting point at which the second path and the sixth path are connected.

15. The recording apparatus according to claim 13, wherein the transporting mechanism includes a first path defining portion which defines the first path, and the first path defining portion defines the first path such that the first path has a portion which is extended to be directed further downward, as the first path becomes closer to a connecting point at which the second path and the sixth path are connected.

* * * * *